United States Patent [19]

Szabo

[11] 3,987,875

[45] Oct. 26, 1976

[54] SUPPORT ACCESSORIES FOR LUGGAGE

[75] Inventor: Bela G. Szabo, Carnegie, Pa.

[73] Assignee: Bruce Plastics, Inc., Pittsburgh, Pa.

[22] Filed: Aug. 29, 1975

[21] Appl. No.: 608,996

[52] U.S. Cl. ..... 190/18 A; 16/30

[51] Int. Cl.[2] ..... A45C 13/00

[58] Field of Search ..... 190/18 A, 18 R; 280/79.1; 16/29, 30, 32, 33

[56] References Cited

UNITED STATES PATENTS

| | | | |
|---|---|---|---|
| 2,478,563 | 8/1949 | Book | 190/18 R |
| 3,185,271 | 5/1965 | Kotkins | 190/18 R |
| 3,655,215 | 4/1972 | Becklin | 190/18 R |
| 3,861,703 | 1/1975 | Gould | 190/18 R |
| 3,879,798 | 4/1975 | Krulwich | 190/18 R |
| 3,889,965 | 6/1975 | Zeitlin | 16/30 |
| 3,889,966 | 6/1975 | Zeitlin | 190/18 R |
| 3,935,613 | 2/1976 | Kaneko | 16/30 |

FOREIGN PATENTS OR APPLICATIONS

| | | | |
|---|---|---|---|
| 225,005 | 2/1969 | Sweden | 16/29 |

*Primary Examiner*—Ro E. Hart
*Attorney, Agent, or Firm*—Samuel Lebowitz

[57] ABSTRACT

Support accessories for luggage which make possible the alternative use of conventional supporting cleats and rollers, depending upon the desires of the user. Retainers of molded plastic are affixed to the luggage for interchangeably accommodating plates bearing feet or bumpers, if a conventional bearing support is desired, or optionally plates of the same dimensions bearing wheeled rollers, if luggage having a rolling capability is desired. The base plates of the retainers are provided with integrally molded projections and a medial recess therebetween to retain the detachable plates more securely while in operation and to facilitate the detachment thereof when a change is to be made.

6 Claims, 13 Drawing Figures

Fig. 1
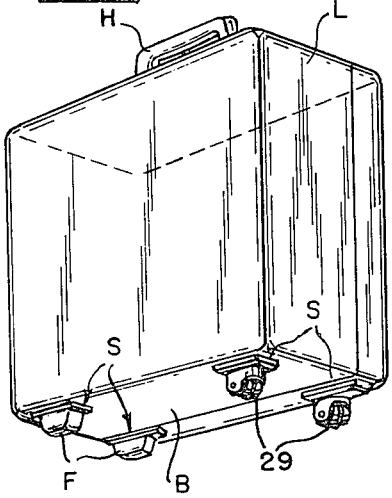
Fig. 2
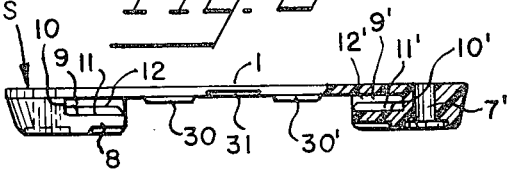
Fig. 3
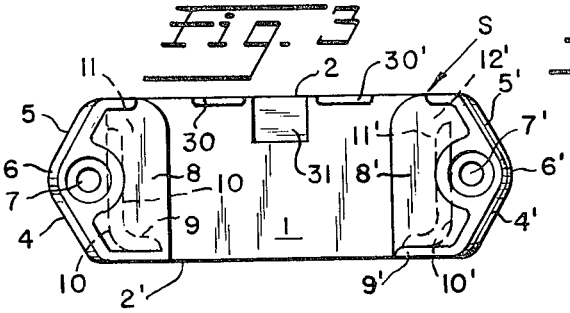
Fig. 4
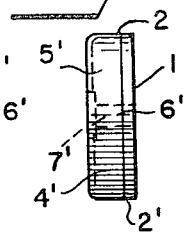
Fig. 8
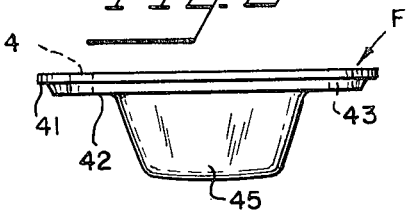
Fig. 9
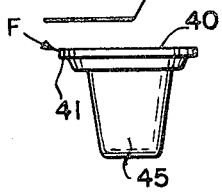
Fig. 5
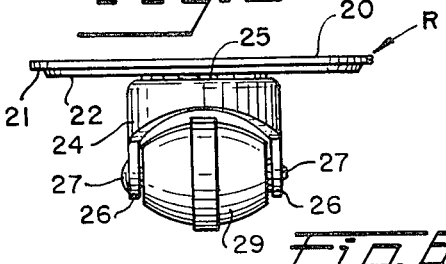
Fig. 10
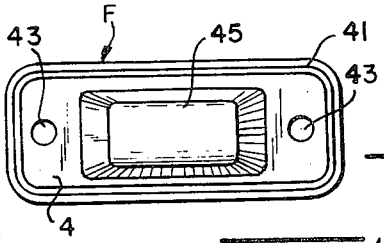
Fig. 6
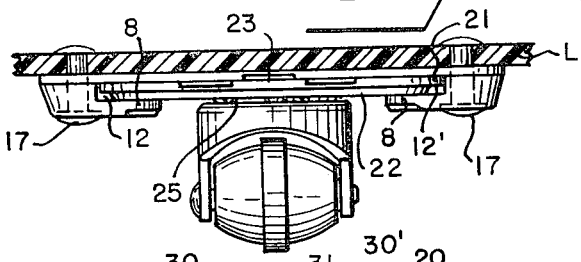
Fig. 11
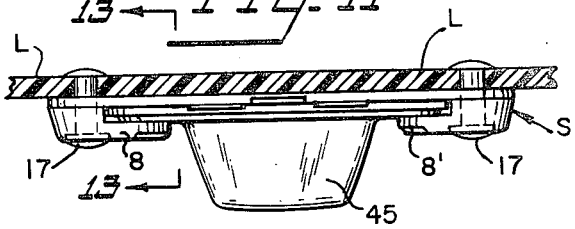
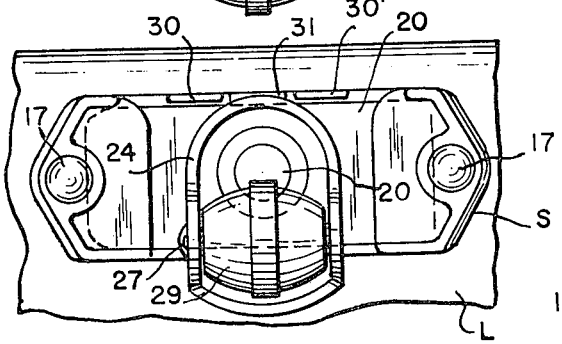
Fig. 12
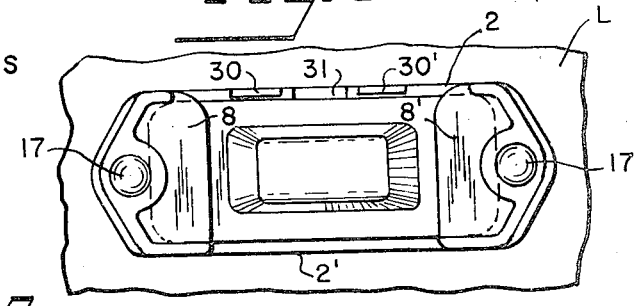
Fig. 7
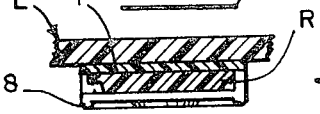
Fig. 13

SUPPORT ACCESSORIES FOR LUGGAGE

This invention relates to support accessories for luggage, and more particularly to flat-like retainers of molded plastic material, which are affixed to the bottom of a luggage unit for detachably receiving either thin plates bearing roller wheels or plastic bumper cleats, to make possible the alternative rolling of the luggage unit or the conventional support thereof.

It is the object of the present invention to provide plastic retainers of rugged and economical construction, which may be fabricated and affixed to a luggage unit either at the time of manufacture or at any time thereafter, to adapt the luggage unit for easy rolling thereof as an alternative to the conventional support of the luggage by foot-bumpers or cleats.

The retainers are molded with special provisions for attaining a secure retention of the alternative supporting plates therein, while enabling a ready disengagement of the latter from the retainers when changes are desired.

Other objects and purposes will appear from the detailed description of the invention following hereinafter, taken in conjunction with the accompanying drawing, wherein FIG. 1 is a perspective view of a luggage unit with the retainers of the invention affixed to the bottom corners thereof, two of which are fitted with plates bearing rollers, and the other two of which are fitted with plates bearing conventional feet or cleats;

FIG. 2 is a front elevation of the retainer in accordance with the invention with the right portion thereof shown in longitudinal section;

FIG. 3 is a bottom view of FIG. 2;

FIG. 4 is a right end view of FIG. 3;

FIG. 5 is a front elevation of a roller assembly for detachable engagement with the molded plastic retainer shown in FIGS. 2 to 4;

FIG. 6 is a front elevation of the roller assembly shown in FIG. 5, fitted within the flat-like plastic retainer shown in FIGS. 2 to 4;

FIG. 7 is a bottom view of FIG. 6;

FIG. 8 is a front elevation of a bumper foot supporting plate of the same dimensions as shown in FIG. 5, having a bumper foot molded as an integral part thereof;

FIG. 9 is a right end view of FIG. 8;

FIG. 10 is a bottom view of FIG. 8;

FIG. 11 is a front elevation of the bumper foot shown in FIGS. 8 to 10, fitted within the molded plastic retainer shown in FIGS. 2 to 4, as an alternative to the assembly shown in FIG. 6;

FIG. 12 is a bottom view of FIG. 11; and

FIG. 13 is a sectional view along line 13—13 of FIG. 11.

In the drawings is shown a luggage unit L which may assume different forms and dimensions and which may be fabricated of different materials. A handle H is provided at the top of the unit and the lowermost surface B is fitted with retainers S at each of the corners of the bottom surface B, two of which are affixed to the main body of the luggage unit, while two are affixed to the lid or cover thereof.

The retainers S in accordance with the invention are molded of plastic material and may be of different colors to accentuate the esthetic effects of the assembly.

The flat-like retainer is constituted of a main base portion 1 having two elongated sides 2,2' with convergently shaped ends 4,5 and 4 ,5' terminating in rounded corners 6,6', respectively. The approximate size of the retainer may be 3 inches long and 1 inch wide.

Openings 7,7' extend through the retainers S adjacent end 6,6' for receiving rivets or bolt fasteners for integrating the retainers to the luggage unit. If desired, the retainer units may be affixed to the surface B by suitable adhesives between the outer surface of the base 1 and the luggage unit without the use of pin or rivet fasteners 17,17' extending through apertures 7,7'.

Confining tongues or tabs 8,8' are molded integrally with the base 1 in spaced relation from the inner face of the latter, with a gap or slot at the front of the base overlying the edge 2, while forming stop walls 9,9' between each of the tabs 8 and 8' at the rear edge 2' of the base, as well as along the transverse walls 10,10' in the passages between the inner face of base 1 and the inner faces of the confining tabs 8,8'.

In order to attain a more secure retention of the interchangeable plates bearing the rollers and bumper feet, as described hereinafter, beads 11 and 11' are molded integrally with the confining tabs 8 and 8' at both the rear walls 9,9' and transverse walls 10,10', respectively, which do not extend as far as the inner face of the base 1, as clearly shown in FIG. 2.

The construction described above provides slots 12,12' below the elongate edge 2 of the retainer for receiving interchangeably a roller assembly R shown in FIGS. 5 to 7, constituted by a metal plate 20 of generally rectangular outline with rounded corners and a perimetric flange 21 in a raised plane from the main plane 22. A rivet 23 is mounted at the center of the plate 22 for supporting a frame 24 having spaced depending legs 26 which are spanned by an axle 27 bearing rotatably a plastic roller 29. The frame 24 may be fitted with a circular groove adjacent to the plate 20 which cooperates with a similar groove in the latter and between which is provided a series of ball bearings 25 to permit an easy swiveling of the frame 24 on the central mounting 23.

Alternatively, the spaced legs 26 may be stamped integrally from the sides of the plate 20 to provide a fixed axle for supporting the roller 29 for rotation around an axis perpendicular to the longitudinal axis of the piece of luggage.

The roller assembly R may be inserted into the retainer B by sliding the ends thereof between the inner face of the base 1 and the confining tabs 8,8'. The rear walls 9,9' provide inner limit stops for the insertion of the plate 20, and the molded beads 11,11' provide guides for the perimetric flange 21 when the plate is inserted into the retainer, limiting any movement thereof perpendicularly to the plane of the plate. To accentuate the secure retention of the plate within the retainer, projections 30,30' are molded integrally with the inner face of base 1 and project below the plane thereof so that these serve as outer stops for the roller plate R following the complete insertion thereof.

In order to facilitate the withdrawal of the plate from the retainer, an inclined slot 31 is molded on the inner face of base 1 to permit the insertion of a tool such as a screw driver in order to flex the base 1 relative to the plane of the plate R to clear the projections 30,30' from the front of the plate and thereby to permit the easy withdrawal thereof. Thus, the stops 30,30', as well as the molded beads 11,11', in addition to the rear and side walls 9,9' and 10,10', respectively, fix the roller plate R securely within the retainer against the accidental detachment therefrom.

FIG. 1 shows the set of retainers S fitted with supporting cleats F of conventional construction, at the rear end of the luggage units. The bumpers of cleats F may be molded as integral bodies of plastic material having a main plate 40 of the same dimensions and contours as the plate 20 in the roller assembly described above. The perimetric flange 41, displaced from the main plate 42, cooperates with the confining tabs and molded ribs in the same manner as does the metallic supporting plate 20 of the roller assembly. The supporting cleat 45 is of hollow construction and is reenforced with internal vertical ribs, as is well known in molding techniques, to afford sufficient strength to the cleats to support the luggage item and to withstand rough handling in the course of usage.

Openings 43 may be provided in the ends of the plate 42 for the reception of rivets or other fasteners, to adapt these plastic feet or bumpers to items of luggage which are not fitted with the molded retainers in accordance with the instant invention. Of course, these plastic cleats may also be affixed to luggage items by means of adhesive.

As described above, the metallic plates bearing rollers are interchangeable with the plastic plates 40 molded integrally with the cleats or bumpers, so that these may be mounted interchangeably within the retainers S in accordance with the invention, as indicated in FIGS. 6–7 and 11–12.

The provision of a set of four roller units R makes possible the insertion of four rollers within the retainers, or four feet or bumpers rather than two of each as shown in FIG. 1. Such mountings may be desirable in some cases even though it is possible to roll the luggage item shown in FIG. 1 by raising the end to which the bumper feet F are affixed.

I claim:

1. In combination with a luggage unit adapted to rest on a surface in spaced relation thereto, a flat retainer of molded plastic material affixed to the lowermost surface of said piece of luggage, for receiving interchangeable thin plates fitted with different support means at the mid-portions thereof for imparting different support and movement capabilities to the luggage unit, comprising a. an elongated solid base having an outer face adjacent to said luggage, b. a pair of confining tabs on the inner face thereof adjacent each end of said retainer spaced slightly below said inner face and integrally molded with said retainer along the rear and side edges of the latter and provided with a slot at the front and above each of said confining tabs to define passages above the latter, c. an elongated substantially rectangular plate detachably mounted on said retainer having the opposite ends thereof adapted to be inserted into said passages and to be maintained in resilient engagement between said inner face and the underlying confining tabs, d. a pair of symmetrically disposed integral projections on the front edge of said inner face of lesser depth than said slots above said confining tabs, for providing a yieldable stop for the forward edge of said plate in its completely nested position in the passages above the confining tabs, e. said projections being separated by a slot at the medial portion of said inner face for accommodating a spreading tool between said inner face of said retainer and said thin plate to effect relative movement therebetween in a transverse direction to an extent sufficient for the clearance of the said forward edge of said plate below said projections, and thereby to permit the withdrawal of said plate from said retainer, and f. means connected at the mid-portion of said plate and projecting beyond the horizontal plane of said tabs for supporting the luggage unit thereby.

2. A device as set forth in claim 1, wherein said last-mentioned means comprises a roller wheel to facilitate rolling movement of said luggage unit.

3. A device as set forth in claim 2, wherein said means comprises a roller of plastic material, a frame for supporting said roller for rotary movement on a horizontal axis, and swivel means for connecting said frame to said thin plate for rotation around a vertical axis.

4. A device as set forth in claim 3 wherein said detachable thin plate and supporting frame for the roller are formed of sheet metal.

5. A device as set forth in claim 1, wherein said last-mentioned means comprises a bumper foot of resilient molded plastic material.

6. A device as set forth in claim 5, wherein said detachable thin plate is of sheet plastic material molded integrally with said bumper foot.

* * * * *